US007020992B1

(12) United States Patent
Christie

(10) Patent No.: US 7,020,992 B1
(45) Date of Patent: Apr. 4, 2006

(54) MESSAGE DISPLAY ASSEMBLY FOR A VEHICLE

(76) Inventor: Joel A. Christie, 900 Great Britain Blvd., Austin, TX (US) 78748

( * ) Notice: Subject to any disclaimer, the term of this patent is extended or adjusted under 35 U.S.C. 154(b) by 0 days.

(21) Appl. No.: 10/972,016

(22) Filed: Oct. 25, 2004

(51) Int. Cl.
*G09F 21/04* (2006.01)

(52) U.S. Cl. ..... 40/593; 248/258.1

(58) Field of Classification Search ..... 40/593; 340/468, 479; 248/285.1
See application file for complete search history.

(56) References Cited

U.S. PATENT DOCUMENTS 1,543,168 A * 6/1925 Larose ..... 40/572
4,449,167 A * 5/1984 Cohen ..... 362/269
4,787,040 A 11/1988 Ames et al.
4,868,542 A * 9/1989 Thompson ..... 340/468
4,928,084 A * 5/1990 Reiser ..... 340/479
5,132,666 A 7/1992 Fahs
D385,580 S 10/1997 Hetzer
6,243,685 B1 6/2001 Welch et al.
6,268,793 B1 7/2001 Rossi
6,300,870 B1 10/2001 Nelson
6,404,334 B1 6/2002 Chao
D478,935 S 8/2003 Gearhart et al.

* cited by examiner

*Primary Examiner*—Cassandra Davis

(57) ABSTRACT

A message display assembly for a vehicle that includes a display for displaying illuminated letter and numeral indicia. The display includes a housing that has a top wall, a bottom wall and a display screen that is mounted in the housing and extends between the top and bottom walls. A mounting is attached to the display for selectively attaching the display to an inner surface of a vehicle rear window. An input assembly is electrically coupled to the display for selecting word indicia that is then transmitting to the display so that the selected word indicia is displayed on the display screen.

4 Claims, 6 Drawing Sheets

MESSAGE DISPLAY ASSEMBLY FOR A VEHICLE

BACKGROUND OF THE INVENTION

1. Field of the Invention

The present invention relates to display devices and more particularly pertains to a new display device for displaying messages out of a window of a vehicle.

2. Description of the Prior Art

The use of display devices is known in the prior art. U.S. Pat. No. 6,243,685 describes a device which is voice operated for displaying a message out of a vehicle. Other types of display devices are shown in U.S. Pat. No. 4,787,040 and U.S. Pat. No. 5,132,666 which both include message displaying systems.

While these devices fulfill their respective, particular objectives and requirements, the need remains for a device which is well suited for being retrofitted to existing vehicle and in particular includes particular mountings for mounting a display to a rear window. Additionally, the device should, upon determination of its user, be selectively mountable on other windows within a vehicle, to an outer surface of the vehicle or possibly removed completely from the vehicle so that it may be brought within a dwelling.

SUMMARY OF THE INVENTION

The present invention meets the needs presented above by generally comprising a display for displaying illuminated letter and numeral indicia. The display includes a housing that has a top wall, a bottom wall and a display screen that is mounted in the housing and extends between the top and bottom walls. A mounting is attached to the display for selectively attaching the display to an inner surface of a vehicle rear window. An input assembly is electrically coupled to the display for selecting word indicia that is then transmitting to the display so that the selected word indicia is displayed on the display screen.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
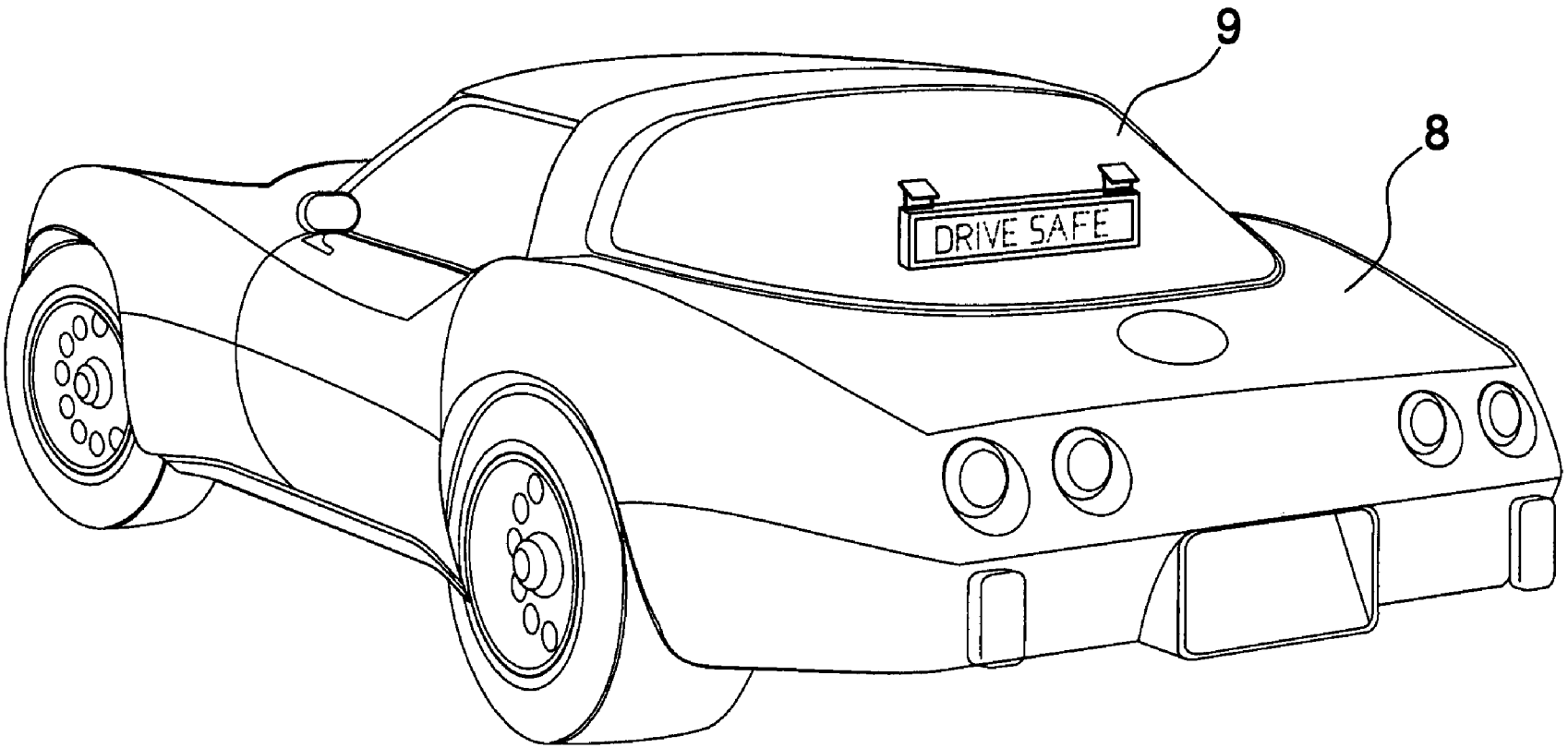
FIG. 1 is a perspective view of a message display assembly for a vehicle according to the present invention.
Figure 2:
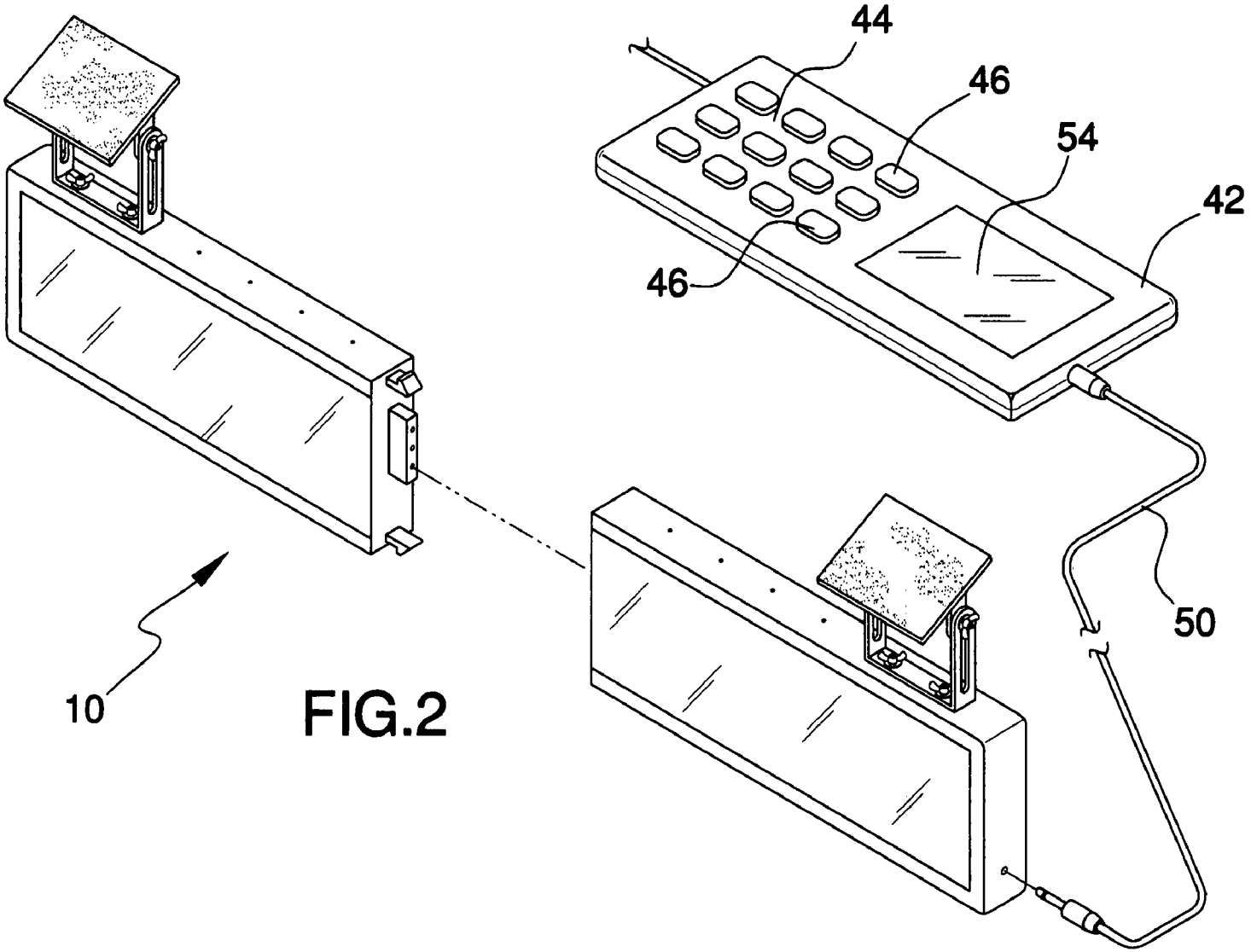
FIG. 2 is a perspective view of the present invention.
Figure 3:
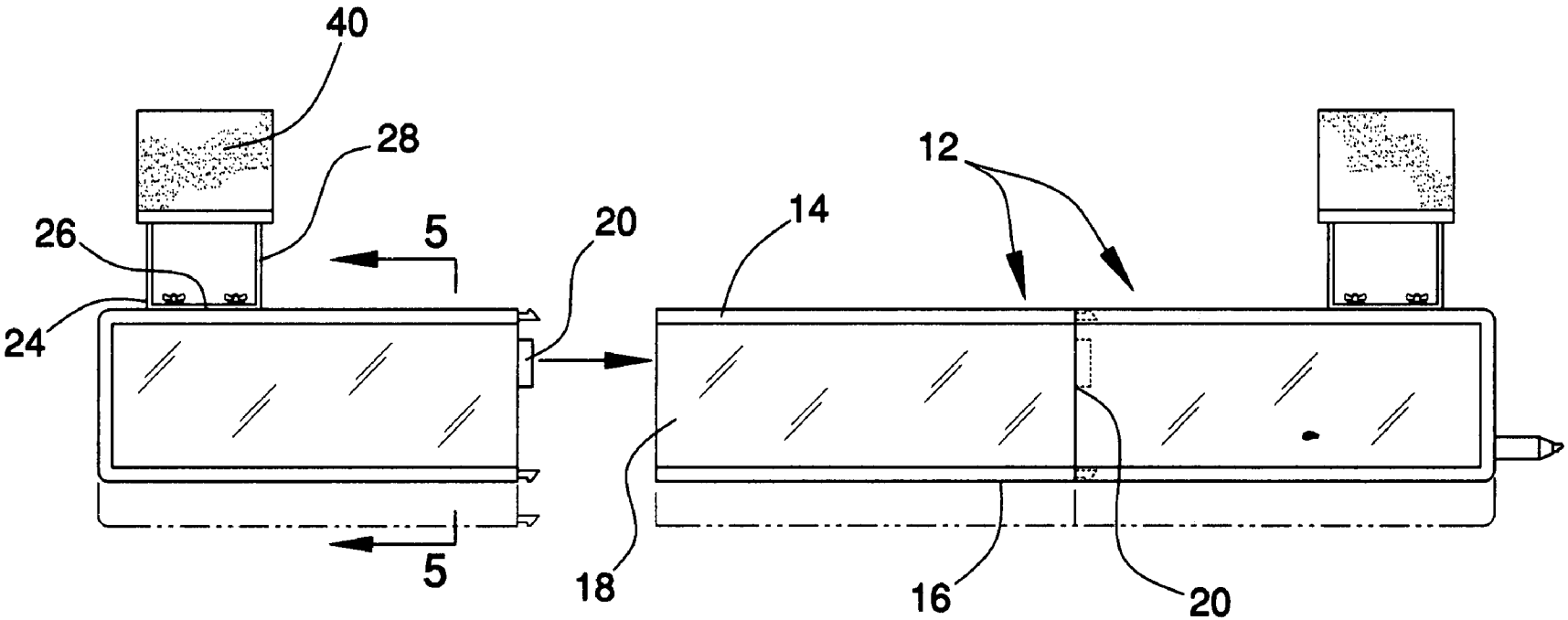
FIG. 3 is a front view of the present invention.
Figure 4:
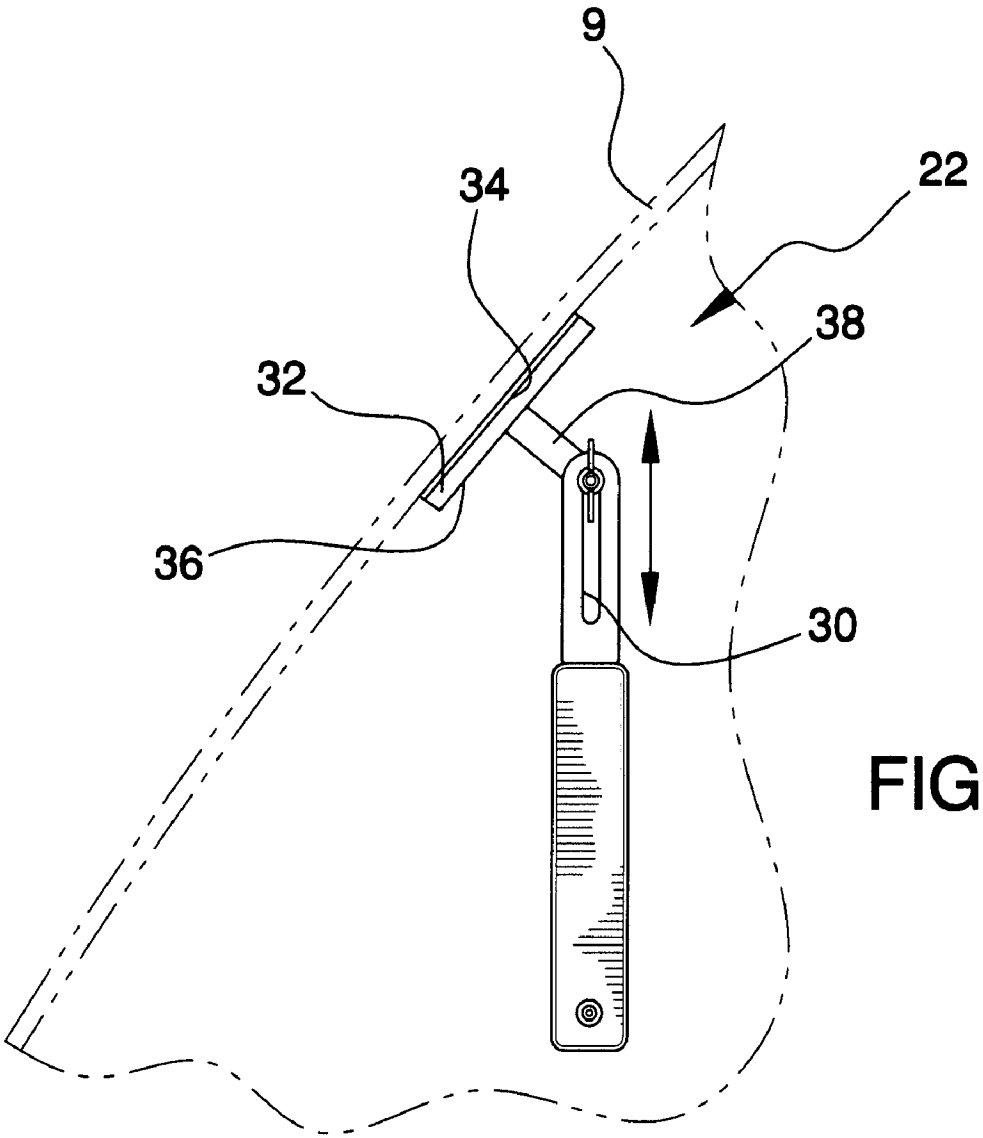
FIG. 4 is a side view of the present invention.
Figure 5:
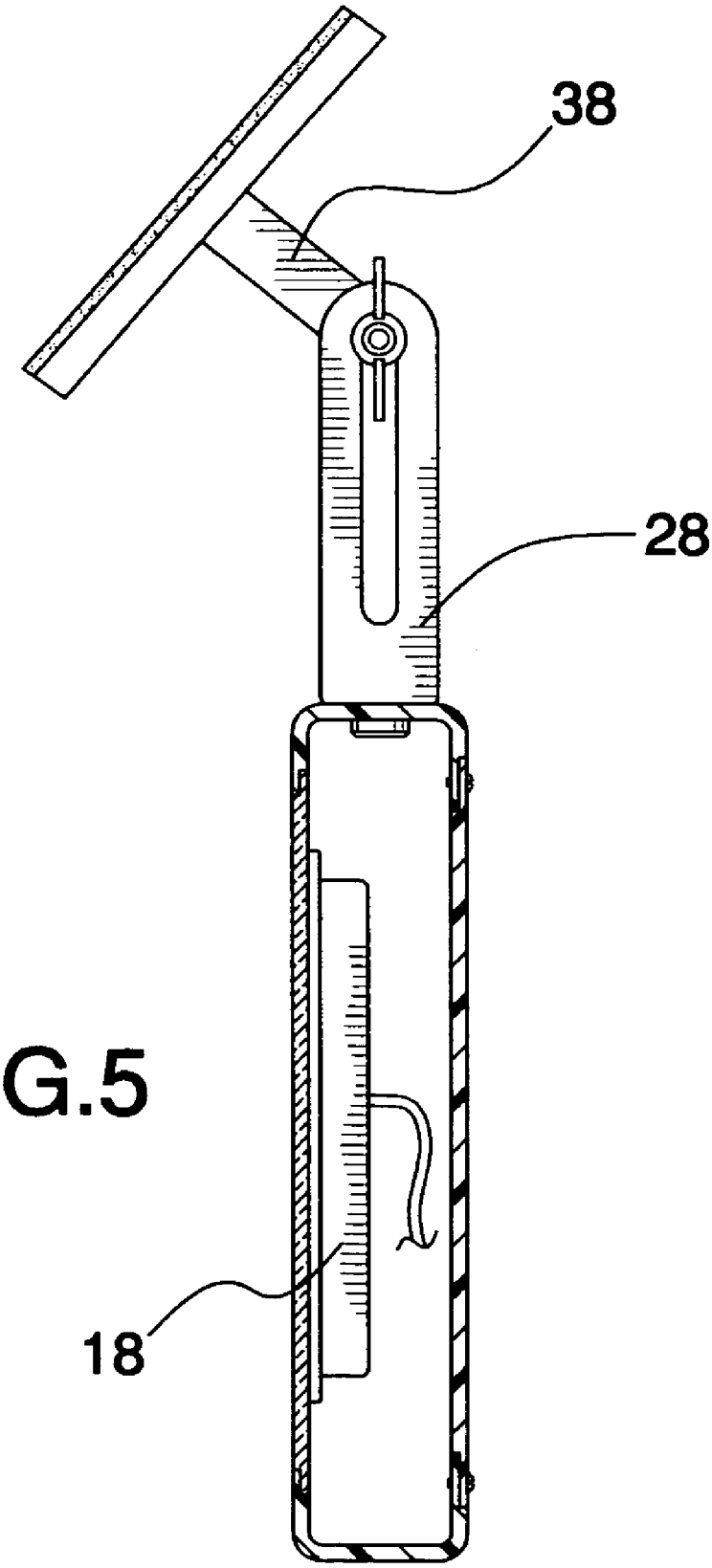
FIG. 5 is a cross-sectional vie taken along line 5—5 of FIG. 3 of the present invention.
Figure 6:
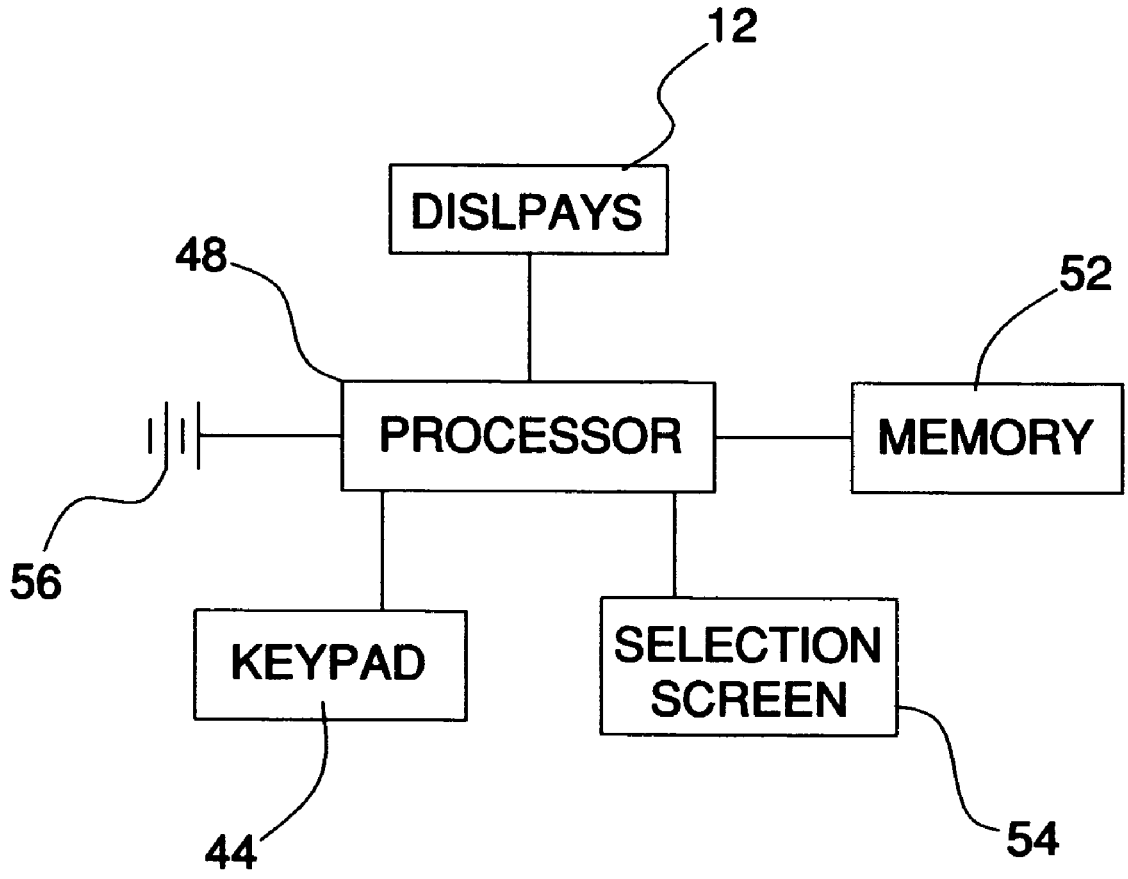
FIG. 6 is an electronic schematic view of the present invention.

With reference now to the drawings, and in particular to FIGS. 1 through 6 thereof, a new display device embodying the principles and concepts of the present invention and generally designated by the reference numeral 10 will be described.

As best illustrated in FIGS. 1 through 6, the message display assembly 10 for a vehicle 8 generally comprises a plurality of displays 12 for displaying illuminated letter and numeral indicia. Each of the displays 12 includes a housing that has a top wall 14, a bottom wall 16 and a display screen 18 that is mounted in the housing and extends between the top 14 and bottom 16 walls. The display screen 18 may be any conventional display screen, such as a CRT or LCD, adapted for depicting illuminated letters and numbers. Each of the displays 12 is selectively attached together such that the top walls 14 are aligned and the display screens 18 are electrically coupled together. This may be done with corresponding male and female couplers 20.

Each of a plurality of mountings 22 is attached to one of the displays 12 for selectively attaching the displays 12 to an inner surface of a vehicle 8 rear window 9. The mountings 22 each include a bracket 24 with a base 26 and a leg 28 extending upwardly from the base 26. The base 26 is attached to a respective one of the top walls 14. The leg 28 has an elongated aperture 30 therein extending from the base 26 to a distal end of the leg 28. The mountings 22 each also include panel 32 that has first side 34 and a second side 36 and an arm 38 that is attached to and extends away from the second side 36 of the panel 32. The arm 38 is pivotally attached to the leg 28 and is selectively positionable along the aperture 30. The mountings 22 may each include a pair of legs 28 and a pair of arms 38. An adhesive 40 is positioned on and substantially covers the first sides 34 of the panels 32. The adhesive secures the panel 32 to the rear window 9. The aperture 30 allows the user of the message display assembly 10 to selectively position the display 12 with respect to the window 9 and allows for variants in angles of rear windows 9.

An input assembly 42 is provided for selecting word indicia and transmitting the selected word indicia to the plurality of displays 12. The input assembly 42 includes a keypad 44. The keypad 44 includes a plurality of keys 46. A conventional processor 48 is electrically coupled to the keypad 44. An output 50 is electrically coupled to the processor 48 and to the plurality of displays 12. An electronic memory storage 52, such as conventional ROM memory, is electrically coupled to the processor 48. It is also contemplated that a read drive be either mounted in the input assembly 42 itself or be selectively in communication therewith by means of an input cable to allow transfer of new indicia and programming to the processor 48 and electronic memory storage 52. A read drive would allow the user to download information off of a data sick, compact disc, digital video disc, floppy disc or other hard memory storage means directly to the electronic memory storage 52. A plurality of word indicia is stored on the memory storage 52. The processor 48 is programmed to assign one of the word indicia to each of the keys 46 so that the assigned word indicia is displayed on the plurality of displays 12 when the corresponding key 46 is actuated. The word indicia may comprise any number of phrases such as "drive safe," "emergency ahead," "stop," "help requested," etc. Additionally, it is preferred that the keypad 44 at least include every letter of the alphabet so that a user of the input assembly 42 has the option of entering single letters, one at a time so that they may form their own word indicia.

The processor 48 will also be adapted for detecting the number of displays 12 being used so that the word indicia are spread out accordingly over 1, 2 or 3 of the displays. It is preferred that a selection screen 54 is electrically coupled to the processor 48 and is adapted for depicting the selected word indicia. The selection screen 54 provides feedback to the user of the display assembly 10 to verify the word indicia selected.

A power supply 56 is electrically coupled to the processor 48. The power supply 56 may comprise an internal supply such as one or more batteries, however it is more preferred that the display assembly 10 include a lighter plug for utilizing the vehicle's power supply. Alternatively, the power supply 56 may be hard wired between the vehicle and the processor 48 to ensure an uninterrupted flow of electricity. Also, a conventional power plug may be included so that the display assembly 10 may be removed from the vehicle and used wherever required by its user.

Also contemplated is operationally coupling the processor 48 to the electrical system of the vehicle 8 so that the processor receives signals from the vehicle 8 when the vehicle's brake lights or turn signals are activates so that the same may be indicate by word indicia on the displays 12. It should be understood that the indicia to be displayed might include single letters, symbols, pictures and signage.

In use, the display 12 or displays are mounted as described above on an inner surface of the rear view window 9 so that the display screens 18 face outwardly of the vehicle 8. When the user decides to convey a message to a vehicle behind them, they actuate one of the keys 46 and the word indicia selected is displayed on the display screens.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A messaging system for mounting in a vehicle window comprising:

a display for displaying illuminated indicia, said display including a housing having a top wall, a bottom wall and a display screen being mounted in said housing and extending between said top and bottom walls;

a mounting being attached to said display for selectively attaching said display to an inner surface of a vehicle rear window;

a bracket including a base and a leg extending upwardly from said base, said base being attached to a respective one of said top walls, said leg having an elongated aperture therein extending from said base to a distal end of said leg, an arm being selectively positionable along said aperture;

a panel having first side and a second side, said arm being attached to and extending away from said second side of said panel, said arm being pivotally attached to said leg;

an adhesive being positioned on and substantially covering said first side of said panel; and an input assembly being electrically coupled to said display for selecting indicia and transmitting selected word indicia to said display such that said selected word indicia is displayed on said display screen.

2. The messaging system of claim 1, wherein said input assembly includes:

a keypad including a plurality of keys;

a processor being electrically coupled to said keypad and to said display;

an electronic memory storage being electrically coupled to said processor, a plurality of indicia being stored on said memory storage, wherein said processor assigns one of said indicia to each of said keys such that the assigned indicia is displayed on said plurality of displays when a corresponding key is actuated; and a power supply being electrically coupled to said processor.

3. The messaging system of claim 2, wherein said input assembly further includes a selection screen being electrically coupled to said processor and being adapted for depicting said selected indicia.

4. A messaging system for mounting in a vehicle window comprising:

a plurality of displays for displaying illuminated letter and numeral indicia, each of said displays including a housing having a top wall, a bottom wall and a display screen being mounted in said housing and extending between said top and bottom walls, each of said displays being selectively attached together such that said top walls are aligned and said display screens are electrically coupled together;

a plurality of mountings, each of said mountings being attached to one of said displays for selectively attaching said displays to an inner surface of a vehicle rear window, each of said mountings including;

a bracket including a base and a leg extending upwardly from said base, said base being attached to a respective one of said top walls, said leg having an elongated aperture therein extending from said base to a distal end of said leg;

a panel having first side and a second side, an arm being attached to and extending away from said second side of said panel, said arm being pivotally attached to said leg and being selectively positionable along said aperture;

an adhesive being positioned on and substantially covering said first side of said panel;

an input assembly for selecting word indicia and transmitting selected word indicia to said plurality of displays, said input assembly including;

a keypad including a plurality of keys;

a processor being electrically coupled to said keypad;

an output being electrically coupled to said processor and to said plurality of displays;

an electronic memory storage being electrically coupled to said processor, a plurality of word indicia being stored on said memory storage, wherein said processor assigns one of said word indicia to each of said keys such that the assigned word indicia is displayed on said plurality of displays when a corresponding key is actuated;

a selection screen being electrically coupled to said processor and being adapted for depicting said selected word indicia; and a power supply being electrically coupled to said processor.

* * * * *